US006276870B1

(12) United States Patent
Smith

(10) Patent No.: US 6,276,870 B1
(45) Date of Patent: Aug. 21, 2001

(54) METHOD OF REPAIRING CABLED REVETMENT BLOCKS

(75) Inventor: Lee A. Smith, Houston, TX (US)

(73) Assignee: Erosion Prevention Products, LLC, Houston, TX (US)

( * ) Notice: Subject to any disclaimer, the term of this patent is extended or adjusted under 35 U.S.C. 154(b) by 0 days.

(21) Appl. No.: 09/528,403

(22) Filed: Mar. 17, 2000

Related U.S. Application Data

(60) Provisional application No. 60/126,064, filed on Mar. 25, 1999.

(51) Int. Cl.[7] ..... E02B 3/12; E02B 3/14

(52) U.S. Cl. ..... 405/17; 405/16; 52/607; 52/747.12; 52/586.1

(58) Field of Search ..... 405/16, 17, 19, 405/20; 404/35, 40–42; 52/223.7, 514, 604, 606–607, 747.1, 747.12, 582.1, 583.1, 586.1, 585.1

(56) References Cited

U.S. PATENT DOCUMENTS

| | | | | |
|---|---|---|---|---|
| Re. 32,663 | | 5/1988 | Atkinson | 405/19 |
| 2,644,497 | * | 7/1953 | Wilmer et al. | 52/223.7 |
| 2,877,506 | * | 3/1959 | Almoslino | 52/223.7 |
| 4,067,089 | | 1/1978 | Forno | 24/205 |
| 4,073,145 | | 2/1978 | Fair | 61/4 |
| 4,201,494 | | 5/1980 | Crowe | 405/17 |

(List continued on next page.)

FOREIGN PATENT DOCUMENTS

| | | |
|---|---|---|
| 2123523 | 5/1975 | (DE) . |
| 2139676A | 11/1984 | (GB) . |
| 59224710 | 12/1984 | (JP) . |

OTHER PUBLICATIONS

Channel Lock® Flexible Revetment System, Jan. 1998.

"Channel Lock © Flexible Concrete Revetment" brochure, Erosion Prevention Products, Inc., Houston, Texas (related to U.S. Patent No. 5,556,2280), Undated.

Case Study: Lakesshore Revetment booklet entitled "Petraflex/Keystone® Protect Lakeshore for New Park," study performed by Petraflex, Minneapolis, MN, 1996.

"Articulated Concrete Revetment System", booklet from Petraflex, Minneapolis, MN., Undated.

Hydraulic Stability of Channel Lock © Concrete Block Revetment System During Overtopping Flow, by Scott Morgan, Carlos Toro–Escobar, and Richard L. Voigt, Jr., Sep. 1996.

Block Blanket Erosion Control System (unknown author) (Undated).

Protec Brochure (Unknown author) (Undated).

Flexblock® Brochure, distributed by Dynoflex of Georgia (Undated).

Conlock Brochure, distributed by Hydro–Turf & Assoc., Inc. (1995).

*Primary Examiner*—David Bagnell
*Assistant Examiner*—Sunil Singh
(74) *Attorney, Agent, or Firm*—Howison, Chauza, Thoma, Handley & Arnott, LLP; Roger N. Chauza

(57) ABSTRACT

A method for installing and replacing revetment blocks in a cabled matrix. Each revetment block has a large opening therein for access to the cables that pass therethrough. The cable of a broken block is severed in the opening, and the parts of the broken block are removed. The ends of the severed cable are threaded through a replacement revetment block, and the block is lowered into place in conjunction with the neighboring blocks. The ends of the severed cable are pulled into the opening in the block and spliced together, preferably using a ferrule that is crimped to the ends of the severed cable. The large opening in each block also facilitates threading the cables through the rows of blocks in a matrix.

20 Claims, 3 Drawing Sheets

U.S. PATENT DOCUMENTS

| | | | |
|---|---|---|---|
| 4,227,829 | 10/1980 | Landry, Jr. | 405/20 |
| 4,286,895 | 9/1981 | Poli et al. | 405/17 |
| 4,297,052 | 10/1981 | Rankin | 405/16 |
| 4,341,489 | 7/1982 | Karnas | 405/35 |
| 4,370,075 | 1/1983 | Scales | 405/20 |
| 4,375,928 | 3/1983 | Crow et al. | 405/20 |
| 4,436,447 | 3/1984 | Crowe | 405/16 |
| 4,499,664 | 2/1985 | Scales | 29/714 |
| 4,502,815 | 3/1985 | Scales et al. | 405/17 |
| 4,564,311 | 1/1986 | Scales | 405/20 |
| 4,592,675 | 6/1986 | Scales et al. | 405/19 |
| 4,664,552 | 5/1987 | Schaaf | 405/20 |
| 4,683,156 | 7/1987 | Waters | 428/52 |
| 4,693,632 | 9/1987 | Ingersoll | 405/18 |
| 4,875,803 | 10/1989 | Scales | 405/16 |
| 4,906,130 | 3/1990 | Manley, Jr. et al. | 405/15 |
| 5,020,938 | 6/1991 | Scales | 405/16 |
| 5,108,222 | 4/1992 | Jansson et al. | 405/20 |
| 5,160,215 | 11/1992 | Jensen | 404/46 |
| 5,288,165 | 2/1994 | Dekker | 404/35 |
| 5,484,230 | 1/1996 | Rudloff | 405/20 |
| 5,556,228 | 9/1996 | Smith | 405/16 |
| 5,622,449 | 4/1997 | Essay, Jr. | 405/19 |
| 5,702,208 | 12/1997 | Hilfiker et al. | 405/258 |
| 5,779,391 | 7/1998 | Knight | 405/20 |
| 5,988,942 * | 11/1999 | Atkinson | 405/20 |

* cited by examiner

METHOD OF REPAIRING CABLED REVETMENT BLOCKS

RELATED APPLICATION

This application claims the benefit of U.S. Provisional Application filed Mar. 25, 1999, Ser. No. 60/126,064, and entitled "METHOD FOR REPAIRING REVETMENT BLOCKS."

TECHNICAL FIELD OF THE INVENTION

The present invention relates in general to erosion control blocks, and more particularly to the type of blocks that are capable of being cabled together to form a secured matrix of blocks.

BACKGROUND OF THE INVENTION

Erosion control blocks provide the basic function of preventing the erosion of soil, sand or other material as a result of runoff water, and the like. The cabling of erosion control blocks together is not in and of itself a new concept. Indeed, many types of erosion control blocks are formed with channels therethrough so as to allow cables to be threaded through a matrix of blocks to secure the blocks together and prevent dislodgment of the blocks during heavy water flow thereover. In addition, the cabling of a matrix of blocks together also allows a large mat of blocks to be installed in watershed areas. In this situation, the ends of the cables are tied to respective beams, and the beams are lifted by a crane so that the entire matrix or mat of blocks can be installed simultaneously. This is especially advantageous in underwater installations where manual labor cannot easily be utilized to install each block, one at a time.

Blocks that are of the interlocking type are well known in the art. Each interlocking block includes plural recesses and plural arms so that when neighboring blocks are engaged, they cannot be laterally separated without being lifted vertically. U.S. Pat. No. 5,556,228 by Smith is one such type of interlocking erosion control block. Even when interlocked, the blocks can be cabled together so as to prevent vertical separation of the blocks, as well as to allow the installation of the blocks as a matrix. In many instances, the blocks can be interlocked together as a matrix at the block-forming plant, and cabled together as a mat. The mat can then be lifted by a crane on a truck and transported to the installation site. Many mats can be stacked together on a truck and transported to the installation site. This requires less manual labor than at the installation site. This technique, however, requires the use of an expensive crane at both the manufacturing plant and the installation site.

Many types of erosion control blocks are fabricated in such a manner that they are very difficult to be cabled together once they are interlocked together or otherwise engaged with each other. In some instances, the blocks must be internally threaded on the cable manually, and then lowered into position in engagement with other blocks. This is not only dangerous and clumsy for the workmen, but it is also time consuming. In other instances, when the erosion control blocks are installed, the cables must be inserted into the end of an outer peripheral block of the mat, and threaded through each inner block of the mat. If the cable channels in each block are not aligned, it is difficult to grasp or otherwise manually manipulate the end of the cable to thread it through all the blocks. This is generally due to the closeness with which each block engages each other, thereby leaving very little space therebetween. Even with some erosion control blocks that have vegetation holes therethrough, the blocks are fabricated so that the cable channels are not formed through the holes.

From the foregoing, it can be seen that with many of the presently made blocks, it is difficult to manually install the blocks at the installation site, and thereafter cable them together so as to provide vertical stability thereto. This technique eliminates the need for a crane at both the manufacturing facility and the installation site.

In any type of cabled revetment block system, irrespective of whether the blocks are of the interlocking type or not, it is not infrequent that one or more of the revetment blocks becomes broken during or after installation. When one or more of the revetment blocks of a mat break, the pieces can be carried away by the water, thus compromising the erosion control capabilities of the matrix. With the blocks available in the prior art, it is extremely difficult, if not impossible, to replace individual blocks of a matrix.

From the foregoing, it can be seen that a need exists for a technique for replacing one or more individual revetment blocks in a cabled matrix. Another need exists for a new revetment block design that allows accessibility to the cable(s) so that the cable can be severed, a new block installed, and the cable(s) spliced to maintain the integrity of the revetment block matrix. Yet another need exists for an installation technique where the blocks can be individually installed over the ground, whether the ground be even or sharply contoured, and thereafter cabled together in an easy and efficient manner.

SUMMARY OF THE INVENTION

Disclosed is a revetment block of the type that allows individual replacement thereof in a cabled matrix system. Also disclosed is a technique for severing the revetment block cables, replacing a damaged block, and splicing the cables without affecting the neighboring revetment blocks. The invention also encompasses a technique for individually installing the erosion control blocks at the site, and thereafter cabling the matrix of blocks together.

In accordance with a preferred embodiment of the invention, each revetment block is constructed so as to have a large opening therein, through which one or more cables pass as they are being threaded through tubular channels in the revetment block. Preferably, although not necessarily, the revetment blocks are of the interlocking type. Should a semi-intact block require replacement, the cable(s) can be manually accessed via the large opening. The cable(s) can be severed, whereupon the remnant parts of the broken block can be removed therefrom. The ends of the severed cable can be threaded through the channels of a new block, and the new block can be lowered into interlocking engagement with the neighboring blocks. The ends of the severed cable are thus accessible via the opening in the replaced revetment block. Then, the ends of the cable can be inserted into a barrel-type ferrule. The repairman can then utilize a crimping tool to thereby crimp the ferrule so that the ends of the severed cable are effectively spliced by the ferrule. With this arrangement, any individual revetment block of a cabled matrix can be replaced, with the end result being that the integrity of the matrix of the whole is reestablished.

In accordance with another feature of the invention, the revetment blocks can be individually installed at the site to form a large mat or matrix of blocks. After installation, the ends of synthetic fiber cables can be manually threaded through each block in a row and column. The large holes in each block allow a person to physically reach into the hole and direct the cable end through the block to the next block. Importantly, the cable can be periodically pulled, via the hole in a block, and take up all the slack in the cable. The threading procedure can then be continued until the end of the mat is reached. The cable end can then be knotted or anchored to prevent it from retracting back into the matrix.

BRIEF DESCRIPTION OF THE DRAWINGS

Further features and advantages will become apparent from the following and more particular description of the preferred embodiment of the invention, as illustrated in the accompanying drawings in which like reference characters generally refer to the same parts, functions or elements throughout the views, and in which.

DETAILED DESCRIPTION OF THE INVENTION

Figure 1:
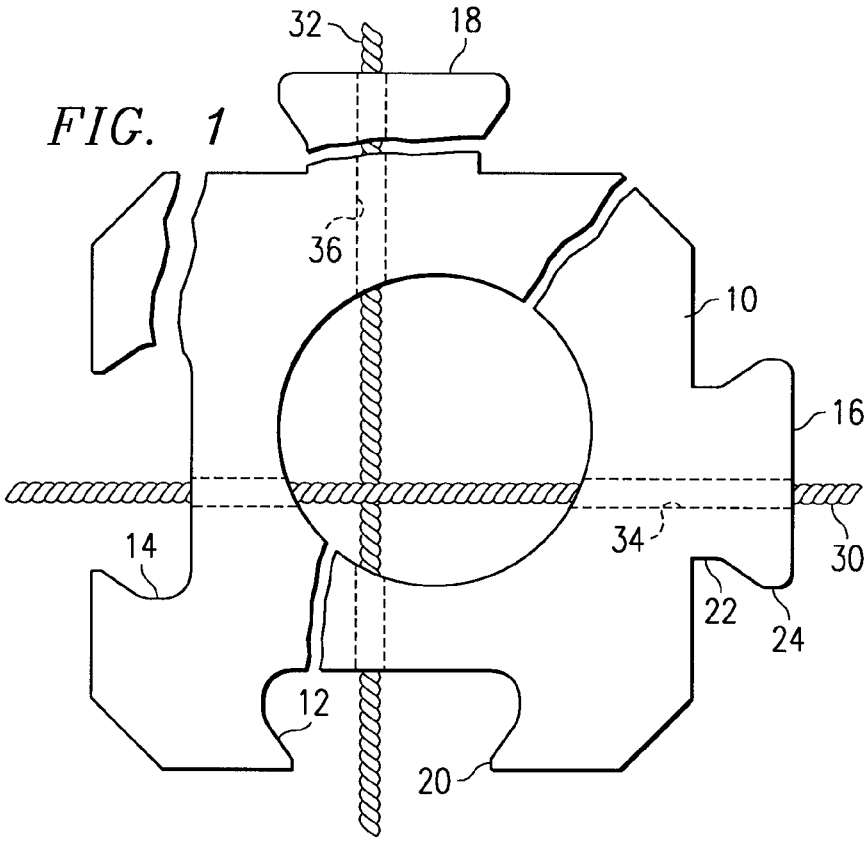
FIG. 1 is a top view of a broken revetment block that is part of a cabled matrix.
Figure 2:
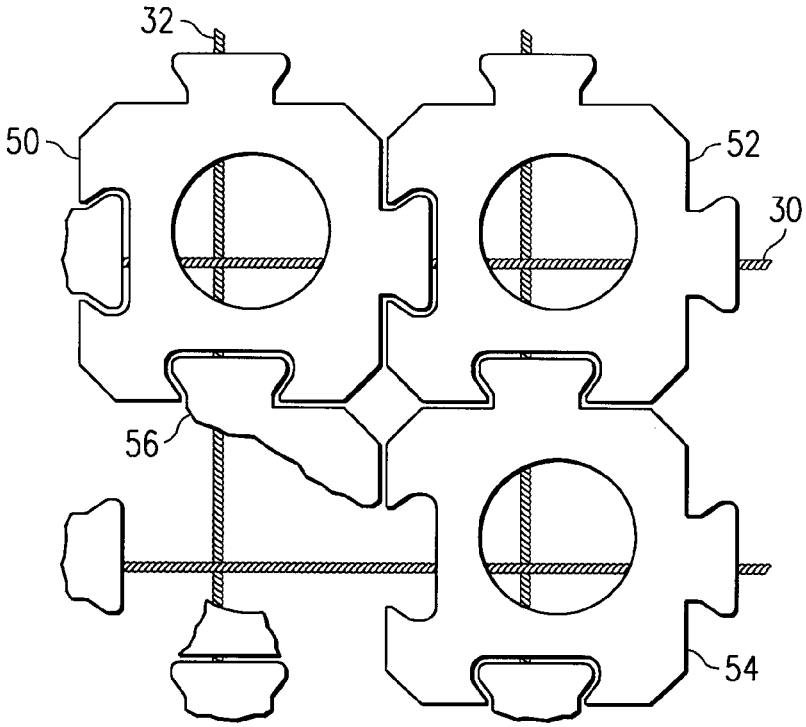
FIG. 2 is a top view of four revetment blocks interlocked together in a matrix, as well as secured vertically by way of cables extending in an X and Y direction.

FIG. 1 illustrates a revetment block 10 that is commercially available under the trademark "Channel Lock", and obtainable from Erosion Prevention Products, LLC, Houston, Tex. Although FIG. 1 illustrates a broken revetment block 10, FIG. 2 illustrates four substantially identical blocks cabled together in a matrix. The revetment block 10 is symmetrical, in that it has a pair of cavities 12 and 14 formed in the body of the block, as well as a pair of arms 16 and 18 that extend from a side edge of the block 10. The cavities 12 and 14 are located 90° apart, while the arms 16 and 18 are located 90° apart. In other embodiments, it is possible to fabricate interlocking blocks with a pair of arms located 180° apart, and a pair of cavities, also located 180° apart. Each cavity, such as cavity 12, is formed so as to have an entrance opening 20 that is smaller than the general cavity itself. In addition, each arm 16 includes a narrowed neck portion 22 that functions to connect an enlarged head 24 to the body of the block. It can be appreciated that when the arm 16 of one block is engaged in a cavity of another block, the blocks are interlocked together so that horizontal movement of block is limited and disengagement of the blocks due to horizontal movement is prevented.

As noted in FIG. 1, the revetment block 10 is broken at various places. Also noted, the block 10 is cabled, such as shown in FIG. 2, to other blocks by way of a first cable 30 that extends in an X direction, and a second cable 32 that extends in a Y direction. The cables extend through respective tubular channels 34 and 36 formed in a conventional manner through the revetment block 10.

FIG. 2 illustrates intact revetment blocks 50, 52 and 54, and broken revetment block 56. Although remnants of the revetment block 56 may remain attached to the cable 32, the underlying soil is substantially exposed so that erosion can readily occur. Unless the cables are severed, a new block cannot be installed in replacement of block 56, except by removing the X-Y cables from all of the blocks, replacing the block, and then rethreading the two cables through the particular row and column of the matrix with which the block 56 intersects.

Figure 3:
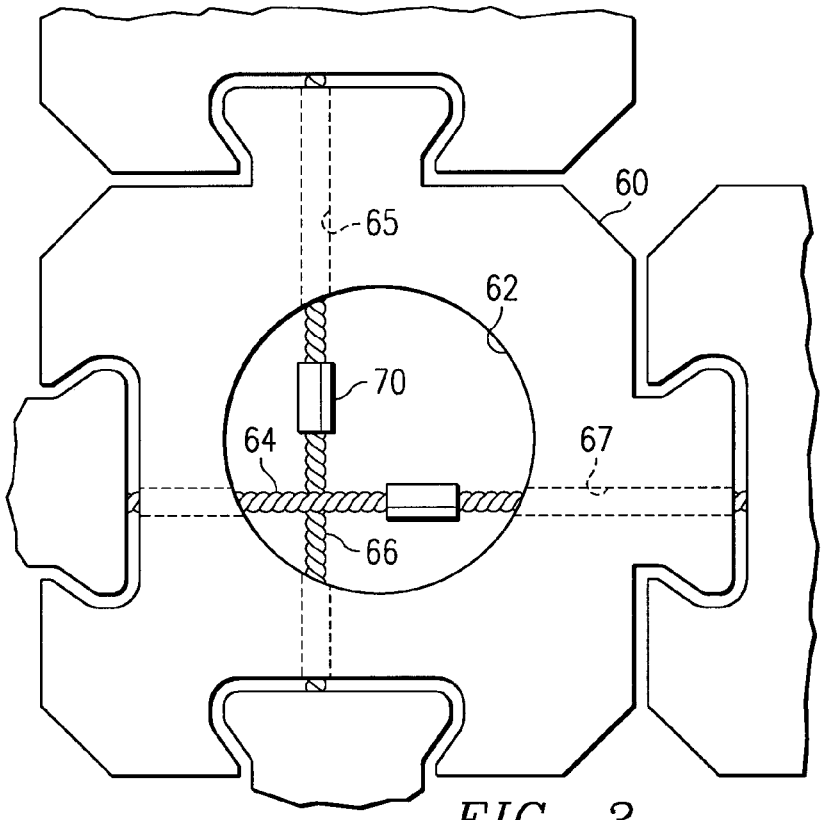
FIG. 3 is a top view of an interlocking revetment block that has been replaced in a cabled matrix, particularly showing the spliced cables.

While many blocks known in the prior art have holes formed therein for the growth of vegetation, and the like, no such blocks other than Applicants are known to have a central hole formed therein that is sufficiently large so that the cables extend therethrough and are accessible by a repairman to both sever the cable, install a new block, and splice the cables back together. In the preferred embodiment of the invention, as shown in FIG. 3, the revetment block 60 has a large hole 62 formed centrally therein so that the cables 64 and 66 are easily accessible therein. Preferably, the revetment blocks 60 are generally 14" wide and 14" long, and about 4" thick, with the hole 62 having a diameter between at least about 5"–7". With this large-diameter hole 62, the cables 64 and 66 are easily accessible by a workman's hands to sever and repair the same, or otherwise manipulate the cable.

In the repair procedure according to the invention, the broken revetment block is first identified. The cables are generally of a 20–27 mm poly revetment synthetic material which can be cut by a sharp blade, or the like. Once the cables 64 and 66 are severed, the broken pieces of the block can be removed without disturbing the neighboring blocks. The four ends of the severed pair of cables can then be threaded through the respective channels 65 and 67 of a replacement revetment block so that the ends protrude into the opening 62. The revetment block 60 can then be vertically slid into an interlocking arrangement with the four neighboring blocks. Alternatively, wires can be fastened to the ends of the cables and threaded through the respective channels 65 and 67 so that the wires protrude in the opening 62. Then, the wires can be utilized to pull the cable ends into the opening 62 either during or after the replacement block has been lowered into engagement with the four neighboring blocks.

Figure 4:
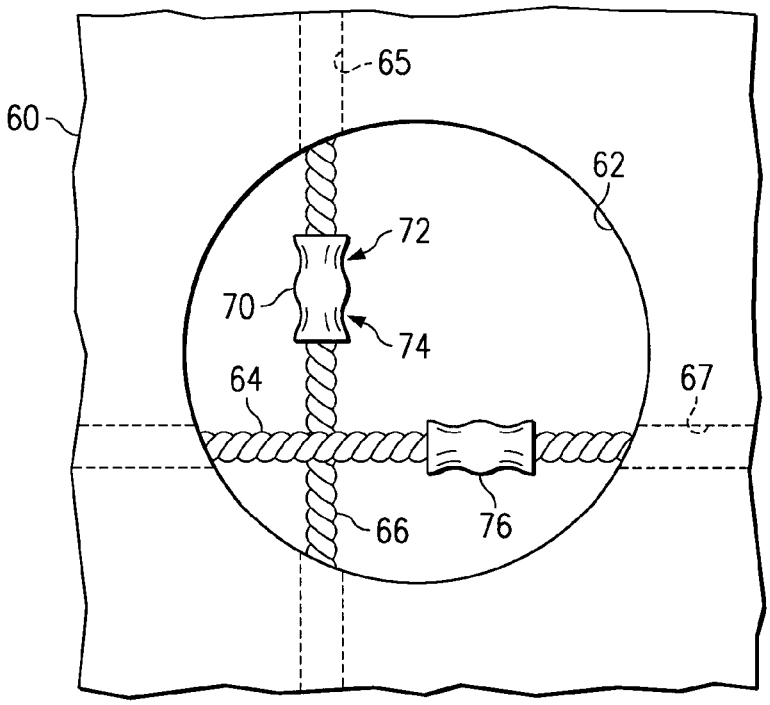
FIG. 4 is an enlarged view of the spliced cables shown in FIG. 3.
Figure 5:
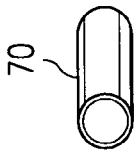
FIG. 5 is an isometric view of a ferrule that is well adapted for splicing poly revetment cables.

Once the ends of the cables are available in the hole 62, an aluminum or copper barrel-type ferrule 70 is used as a splice. The ferrule 70 can be slid onto one end of the cable 66 and crimped with an appropriate crimping tool. Conventional crimping tools can be utilized so as to squeeze and permanently deform the ferrule 70 around the cable 66, thereby permanently fastening the ferrule to the end of the cable. Then, the other end of the cable 66 can be slid into the other open end of the ferrule 70 and crimped in a similar manner. The ferrule 70 is thus effective to splice the cable 66 together to prevent the block from being vertically lifted from the matrix during high volume and high velocity water flow situations. As clearly shown in FIG. 4, a first crimp 72 is effective to firmly attach the ferrule 70 to one end of the cable 66. A second crimp 74 is effective to connect the other end of the cable 66 to the ferrule 70, thus providing a high quality splice. The ferrule 76 is similarly crimped to the two ends of the cable 64. The ferrule itself is shown in FIG. 5. Such ferrules are conventionally available and made for splicing poly revetment cables together. Typically, such ferrules can be obtained from C.J. Roberds Manufacturing, Inc., known as aluminum sleeves and aluminum button stops.

While the foregoing describes a technique for severing the cable at the replacement block location, the cable (or cables) can be severed at another location For example, if for some reason it is more convenient to sever the cable(s) in neighboring blocks in another row and/or column of blocks in the matrix, then this can be easily accomplished. Once the cables running through the broken block are severed elsewhere in the matrix, then the replacement block can be installed and the cable ends run therethrough and spliced at the location where such cables were severed. In the event that two or more cables extend through the broken block in perpendicular directions, then a splice would be carried out in two different neighbor or remote blocks.

Figure 6:
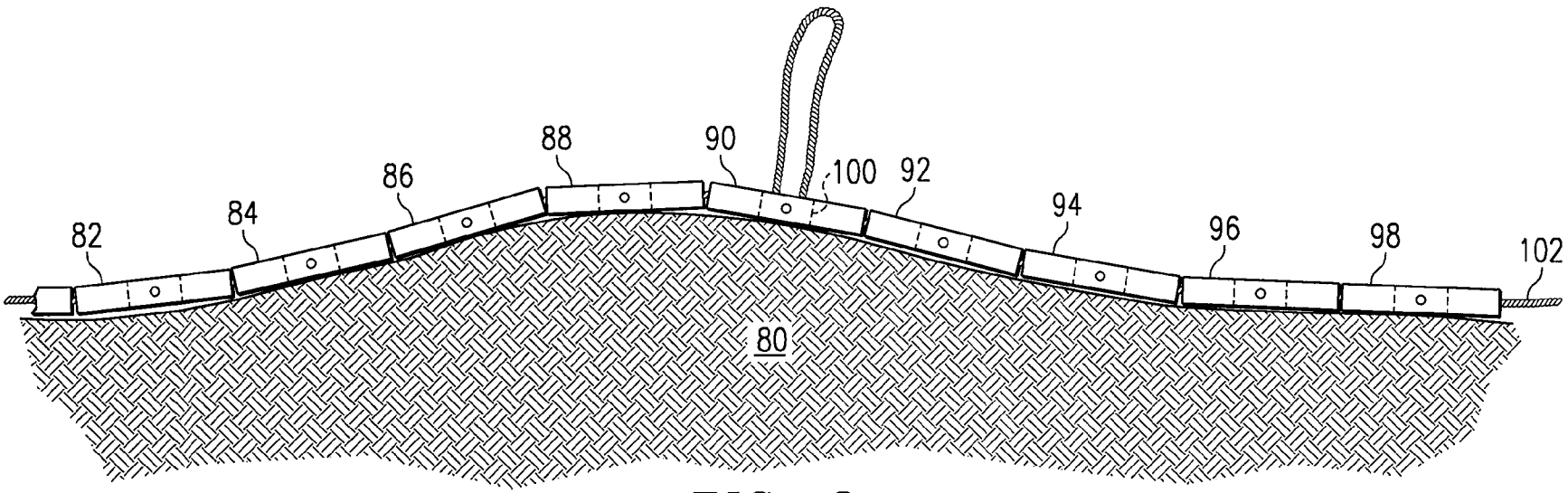
FIG. 6 is a side view of a row of erosion control blocks, showing the manner in which the hole in a block can be utilized to facilitate threading of the cable through all the blocks in the row.

FIG. 6 illustrates the advantage in a cabled system of the large hole formed through each revetment block. Illustrated is a contoured flood plane 80 over which a mat of erosion control blocks 82–98 are individually installed. Preferably, each block of the grid can be manually installed by a workman, irrespective of whether the blocks are interlocked together, or not. As noted above, the manual installation of the individual blocks eliminates the need for a crane at either the manufacturing plant or the installation location.

Once the erosion control blocks 82–98 of a matrix are installed, they are preferably anchored together by poly revetment cables to prevent the blocks from being lifted by the hydraulic pressure of water flowing over and around the matrix. As noted above, each erosion control block 82–98 preferably includes a large central opening, such as shown by reference 100 with respect to block 90. The cable 102 can be manually threaded through a tubular channel (not shown) formed in each block. The opening 100 in each block facilitates the threading of the cable 102 through each individual block. The large opening 100 allows a workman to physically grasp the cable end that appears in the opening 100 so that it can be threaded through the remainder of the block, and into the corresponding tubular channel of the adjacent block. Were it not for such an opening 100, and because such blocks are laid in close proximity to each other, the cable 102 or the end thereof would be inaccessible to the workmen.

When the blocks are installed on an uneven terrain, such as shown in FIG. 6, the cable channels of adjacent blocks are not likely to be aligned. Hence, the large opening 100 again facilitates the grasping of the cable 102 for threading from one block to the other block. In addition, the cable 102 need not be threaded through an entire row of blocks of a matrix before the slack is taken up. Rather, and as shown in FIG. 6, a workman can grasp the cable in the opening of any one of the blocks 82–98, and pull the same from one direction to remove the slack therein. Moreover, the cable can be pulled in a large loop as shown in FIG. 6 to provide additional length of cable so as to continue the threading process. It can be seen that by use of the large holes 100, the installation process is facilitated in a cabled matrix.

From the foregoing, it can be seen that a technique has been disclosed for efficiently replacing broken revetment blocks in a cabled matrix. A large hole formed in the revetment block at a location where the cable(s) passes through the block provides an access opening for severing and splicing the cable. A workman can easily sever the cable to remove the old block, thread the ends of the severed cable through a replacement block and then splice the cable together to thereby repair the matrix with minimal disturbance and rethreading of the cable ends.

What is claimed is:

1. A method of cabling erosion control blocks together with a cable, comprising the steps of:

installing apertured erosion control blocks on a plane to be protected from erosion, said apertured erosion control blocks having at least one cable channel formed therethrough so as to intersect with said aperture;

reaching by a workman into the aperture of at least one apertured erosion control block to grasp a cable end; and manipulating the cable end to achieve securement of the apertured erosion control blocks.

2. The method of claim 1, further including manipulating the end of the cable in said aperture to splice two ends of said cable.

3. The method of claim 2, further including splicing said cable in said aperture.

4. The method of claim 2, further including splicing said cable using a barrel-shaped ferrule that is deformable.

5. The method of claim 4, further including crimping said ferrule to both cable ends within said aperture.

6. The method of claim 1, further including manipulating said cable within the aperture which has a diameter of about 5 inches.

7. The method of claim 1, further including manipulating a pair of cable ends within said aperture.

8. The method of claim 1, further including manipulating said cable by pulling said cable via said aperture to form a loop in said cable.

9. The method of claim 8, further including pulling said cable in said loop to remove slack in said cable.

10. The method of claim 1, further including manipulating said cable in said aperture by pulling on the cable end and threading the cable end through another cable channel of said apertured erosion control block.

11. The method of claim 10, further including threading the cable end of said cable through a cable channel of an adjacent apertured erosion control block.

12. A method of cabling erosion control blocks together with a cable, comprising the steps of:

in a matrix of erosion control blocks that are cabled together, identifying at least one erosion control block to be replaced;

severing the cable near the location of the erosion control block to be replaced;

removing the erosion control block identified for replacement;

threading the ends of the severed cable through the replacement erosion control block; and splicing the ends of the severed cable by fastening the ends together.

13. The method of claim 12, further including fastening the ends of the severed cable by using a tubular ferrule crimped to the ends of the severed cable.

14. The method of claim 12, wherein an aperture is formed in said replacement erosion control block from one face thereof to another face thereof.

15. The method of claim 12, further including splicing two cables threaded through respective cable channels formed in the replacement erosion control block.

16. The method of claim 12, wherein at least one erosion control block includes an aperture formed therein from one face to another face thereof, and a cable channel formed through the replacement erosion control block intersects the aperture, and further including inserting a splicing tool into the aperture in the erosion control block to splice the cable ends together.

17. A method of cabling erosion control blocks together, comprising the steps of:

severing a cable extending through a plurality of erosion control blocks, said cable functioning to limit lateral movement of said plurality of erosion control blocks;

removing a damaged erosion control block from said plurality of erosion control blocks;

installing a replacement erosion control block in a position previously occupied by the damaged erosion control block, said installing step including installing the replacement erosion control block with an aperture formed therethrough;

threading the severed ends of said cable through said replacement erosion control block until the severed ends protrude within the aperture of the replacement erosion control block; and connecting the ends of the severed cable together to again limit lateral movement of the plurality of the erosion control blocks.

18. The method of claim 17, further including connecting the ends of the severed cable together using a ferrule crimped to the severed ends of the cable.

19. The method of claim 18, further including pulling the severed ends of the cable together to tighten the severed cable, and then connecting the ends of the severed cable using said ferrule.

20. The method of claim 17, wherein each erosion control block of said plurality includes an arm with an enlarged end portion, and a cavity formed in each said erosion control block, the enlarged portion of an arm of one erosion control block interlocking with a cavity of a neighbor erosion control block to prevent lateral disengagement of the interlocking erosion control blocks, and further including threading one end of the severed cable through the cavity of the replacement interlocking erosion control block, and threading a different end of the severed cable through an arm of the replacement interlocking erosion control block, and connecting the ends of the severed cable in the aperture formed in the replacement interlocking erosion control block.

* * * * *